US005950590A

United States Patent [19]

Everts et al.

[11] Patent Number: 5,950,590

[45] **Date of Patent: *Sep. 14, 1999**

[54] OPERATOR CARRIED POWER TOOL HAVING A FOUR-CYCLE ENGINE AND AN ENGINE LUBRICATION METHOD

[75] Inventors: Robert G. Everts, Chandler, Ariz.; Katsumi Kurihara, Hiroshima-ken, Japan

[73] Assignee: Ryobi Outdoor Products, Inc., Chandler, Ariz.

[ * ] Notice: This patent is subject to a terminal disclaimer.

[21] Appl. No.: 09/028,376

[22] Filed: Feb. 24, 1998

Related U.S. Application Data

[63] Continuation of application No. 08/895,345, Jul. 16, 1997, Pat. No. 5,738,062, which is a continuation of application No. 08/651,154, May 21, 1996, abandoned, which is a continuation of application No. 08/065,576, May 2, 1993, Pat. No. 5,558,057, which is a continuation of application No. 07/801,026, Dec. 2, 1991, Pat. No. 5,241,932.

[51] Int. Cl.[6] ..... F01M 1/00

[52] U.S. Cl. ..... 123/196 R; 123/90.33; 123/311; 184/11.1; 30/276

[58] Field of Search ..... 123/84, 90.33, 123/193.5, 195 R, 196 R, 311; 184/6.5, 6.8, 6.9, 6.26, 11.1, 13.1; 30/276

[56] References Cited

U.S. PATENT DOCUMENTS

| | | | |
|---|---|---|---|
| 2,559,134 | 7/1951 | Steele | 184/11 |
| 3,757,882 | 9/1973 | Honda . | |
| 4,391,041 | 7/1983 | Porter-Bennett . | |
| 4,563,986 | 1/1986 | Nakano . | |
| 4,688,529 | 8/1987 | Mitadera et al. . | |
| 4,817,738 | 4/1989 | Dorner et al. . | |
| 4,969,434 | 11/1990 | Nakagawa | 123/90.33 |

FOREIGN PATENT DOCUMENTS

| | | |
|---|---|---|
| 3335962 A1 | 5/1985 | Germany . |
| 2 129 054 | 5/1984 | United Kingdom . |

OTHER PUBLICATIONS

W. Beitz and K.–H. Küttner, Engineering Manual, 1983, pp. 1–4.

*Primary Examiner*—Noah P. Kamen
*Attorney, Agent, or Firm*—Brinks Holer Gilson & Lione

[57] ABSTRACT

An engine powered hand-held power tool and engine lubrication method is provided, the power tool being intended to be carried by an operator during use. The power tool has a frame, including a handle to be grasped by the operator, an implement affixed to the frame having a rotary input member, and a small four-cycle, lightweight, internal combustion engine attached to the frame for driving the implement. The four-cycle engine has a lightweight aluminum alloy engine block having a cylindrical bore and an enclosed oil reservoir formed therein. A crankshaft is rotatably mounted in the engine block for rotation about a crankshaft axis. A piston reciprocates within the bore and is connected to the crankshaft by a connecting rod. An oil splasher driven by the crankshaft intermittently engages the oil within the enclosed oil reservoir to splash-lubricate the engine. The engine is provided with a cylinder head assembly defining a compact combustion chamber having a pair of overhead intake and exhaust ports and cooperating intake and exhaust valves. A lightweight, high-powered engine is thereby provided having relatively low HC and CO emissions.

12 Claims, 5 Drawing Sheets

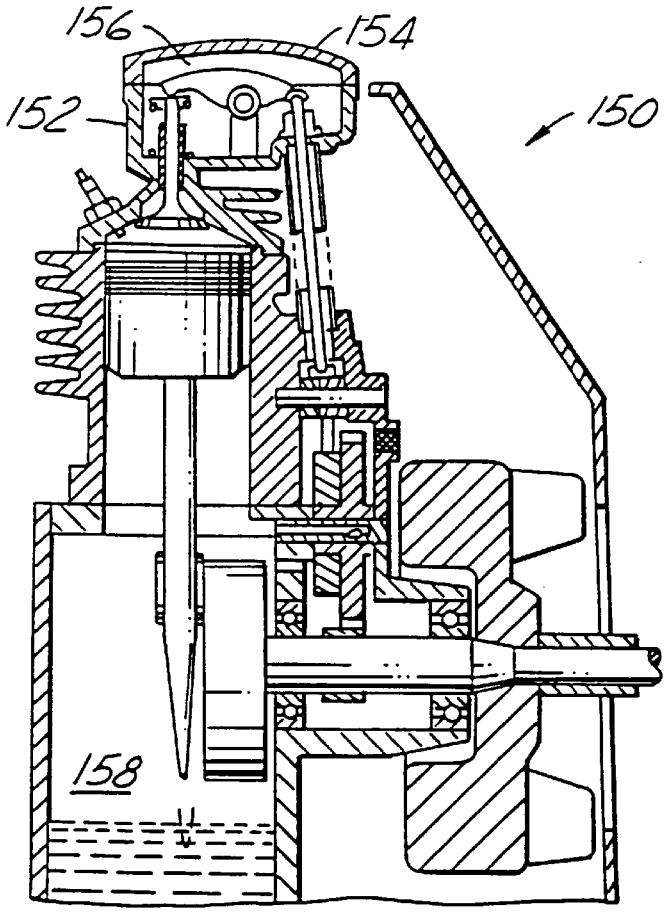
Fig-7
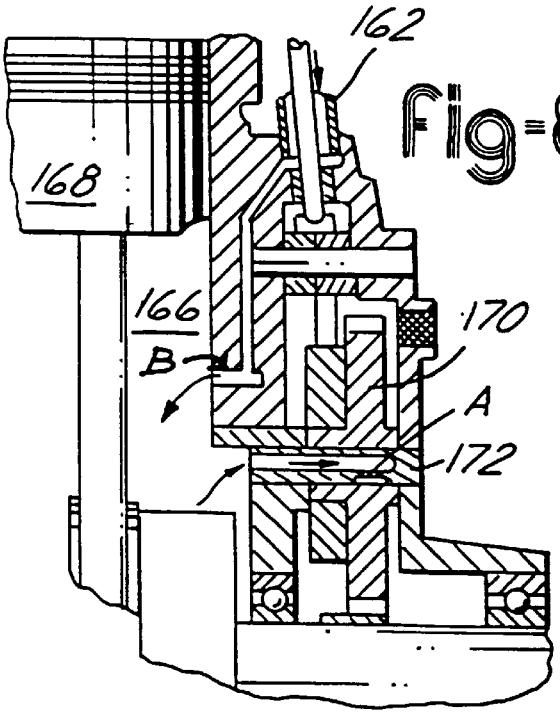
Fig-8
Fig-9
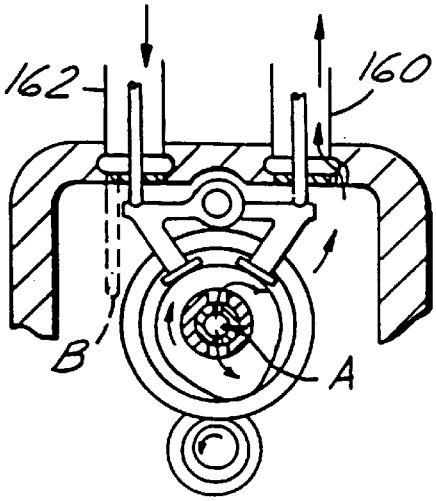

OPERATOR CARRIED POWER TOOL HAVING A FOUR-CYCLE ENGINE AND AN ENGINE LUBRICATION METHOD

CROSS-REFERENCE TO RELATED APPLICATIONS

This application is a continuation of U.S. patent application Ser. No. 08/895,345, filed Jul. 16, 1997, (now issued U.S. Pat. No. 5,738,062), which is a continuation of U.S. patent application Ser. No. 08/651,154, May 21, 1996, abandoned which in turn is a continuation of U.S. patent application Ser. No. 08/065,576, filed May 2, 1993 (now issued U.S. Pat. No. 5,558,057), which is a continuation of Ser. No. 07/801,026, filed Dec. 2, 1991 (now issued U.S. Pat. No. 5,241,932).

TECHNICAL FIELD

This invention relates to operator carried power tools and more particularly, to operator carried power tools driven by a small internal combustion engine.

BACKGROUND ART

Portable operator carried power tools such as line trimmers, blower/vacuums, or chain saws are currently powered by two-cycle internal combustion engines or electric motors. With the growing concern regarding air pollution, there is increasing pressure to reduce the emissions of portable power equipment. Electric motors unfortunately have limited applications due to power availability for corded products and battery life for cordless devices. In instances where weigh is not an overriding factor such as lawn mowers, emissions can be dramatically reduced by utilizing heavier four-cycle engines. When it comes to operator carried power tools such as line trimmers, chain saws and blower/vacuums, four-cycle engines pose a very difficult problem. Four-cycle engines tend to be too heavy for a given horsepower output and lubrication becomes a very serious problem since operator carried power tools must be able to run in a very wide range of orientations.

The California Resource Board (CARB) in 1990 began to discuss with the industry, particularly the Portable Power Equipment Manufacturer's Association (PPEMA), the need to reduce emissions. In responding to the CARB initiative, the PPEMA conducted a study to evaluate the magnitude of emissions generated by two-cycle engines in an effort to determine whether they were capable of meeting the proposed preliminary CARB standards tentatively scheduled to go into effect in 1994. The PPEMA study concluded that at the present time, there was no alternative power source to replace the versatile lightweight two-stroke engine currently used in hand held products. Four-cycle engines could only be used in limited situations, such as in portable wheeled products like lawn mowers or generators, where the weight of the engine did not have to be borne by the operator.

It is an object of the present invention to provide a hand held powered tool which is powered by an internal combustion engine having low emissions and is sufficiently light to be carried by an operator.

It is a further object of the present invention to provide a portable hand held powered tool powered by a small internal combustion engine having an internal lubrication system enabling the engine to be run at a wide variety of orientations typically encountered during normal operation.

It is a further object of the present invention to provide a portable power tool to be carried by an operator which is driven by a small lightweight four-cycle engine having an aluminum engine block, an overhead valve train and a splasher lubrication system for generating an oil mist to lubricate the crank case throughout the normal range of operating positions.

It is yet a further object of the invention to provide an oil mist pumping system to pump an oil mist generated in the crank case into the overhead valve chamber.

These objects and other features and advantages of the present invention will be apparent upon further review of the remainder of the specification and the drawings.

DISCLOSURE OF THE INVENTION

Accordingly, a portable hand held power tool of the present invention intended to be carried by an operator is provided utilizing a small four-cycle internal combustion engine as a power source. The four-cycle engine is mounted on a frame to be carried by an operator during normal use. The tool has an implement cooperating with the frame having a rotary driven input member coupled to the crankshaft of the four-cycle engine. The four-cycle engine is provided with a lightweight aluminum engine block having at least one cylindrical bore oriented in a normally upright orientation having an enclosed oil reservoir located therebelow. A crankshaft is pivotably mounted within the engine block. The enclosed oil reservoir when properly filled, enables the engine to rotate at least 30 degrees about the crankshaft axis in either direction without oil within the reservoir rising above the level of the crankshaft counter weight. A splasher is provided to intermittently engage the oil within the oil reservoir to generate a mist to lubricate the engine crank case.

One embodiment of the invention pumps an oil mist from the crank case to an overhead valve chamber to lubricate the valve train.

In yet another embodiment of the invention, the overhead valve chamber is sealed and is provided with a lubrication system independent of the crank case splasher system.

BRIEF DESCRIPTION OF THE DRAWINGS

FIG. 7 is a cross-sectional side view of a third engine embodiment;

FIG. 8 is an enlarged cross-sectional view of the third engine embodiment of FIG. 7 illustrating the lubrication system;

FIG. 9 is a partial cross-sectional end view of the third engine embodiment shown in FIGS. 7 and 8 further illustrating the lubrication system;

BEST MODES FOR CARRYING OUT THE INVENTION

Figure 1:
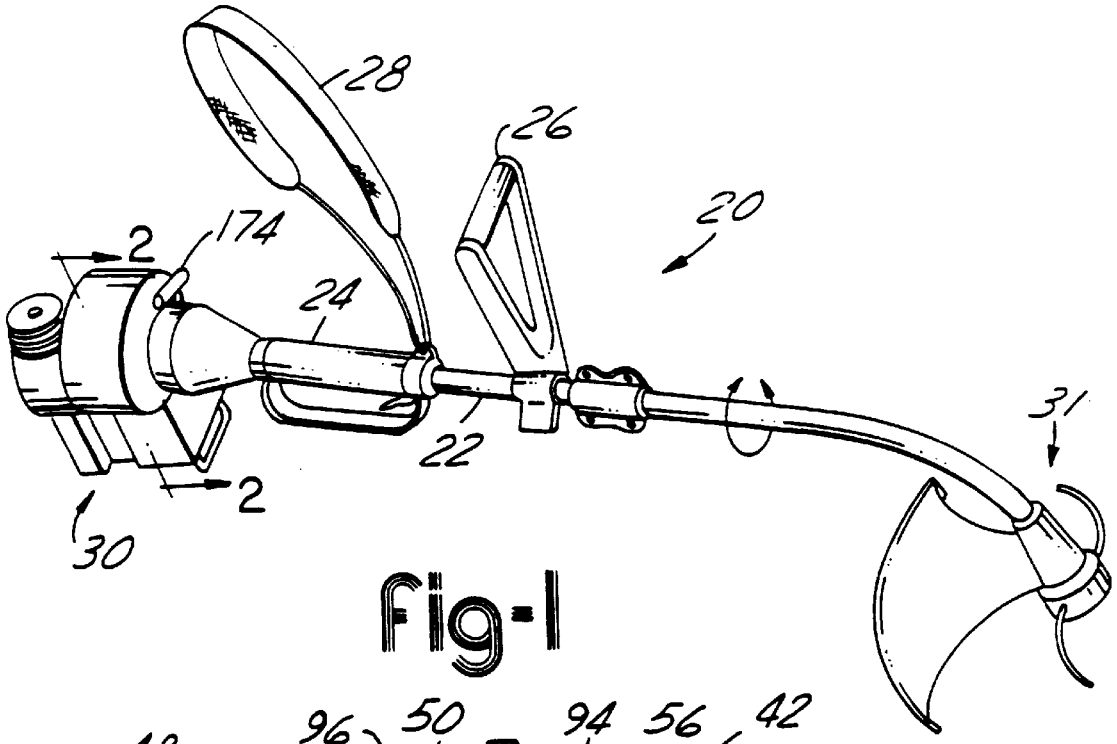
FIG. 1 is a perspective view illustrating a line trimmer of the present invention.

FIG. 1 illustrates a line trimmer 20 made in accordance with the present invention. Line trimmer 20 is used for illustration purposes and it should be appreciated that other hand held power tools tended to be carried by operators such as chain saws or a blower vacuum can be made in a similar fashion. Line trimmer 20 has a frame 22 which is provided by an elongated aluminum tube. Frame 22 has a pair of handles 24 and 26 to be grasped by the operator during normal use. Strap 28 is placed over the shoulder of the user in a conventional manner in order to more conveniently carry the weight of the line trimmer during use. Attached to one end of the frame generally behind the operator is a four-cycle engine 30. The engine drives a conventional flexible shaft which extends through the center of the tubular frame to drive an implement 32 having a rotary cutting head or the like affixed to the opposite end of the frame. It should be appreciated that in the case of a chain saw or a blower/vacuum, the implement would be a cutting chain or a rotary impeller, respectively.

Figure 2:
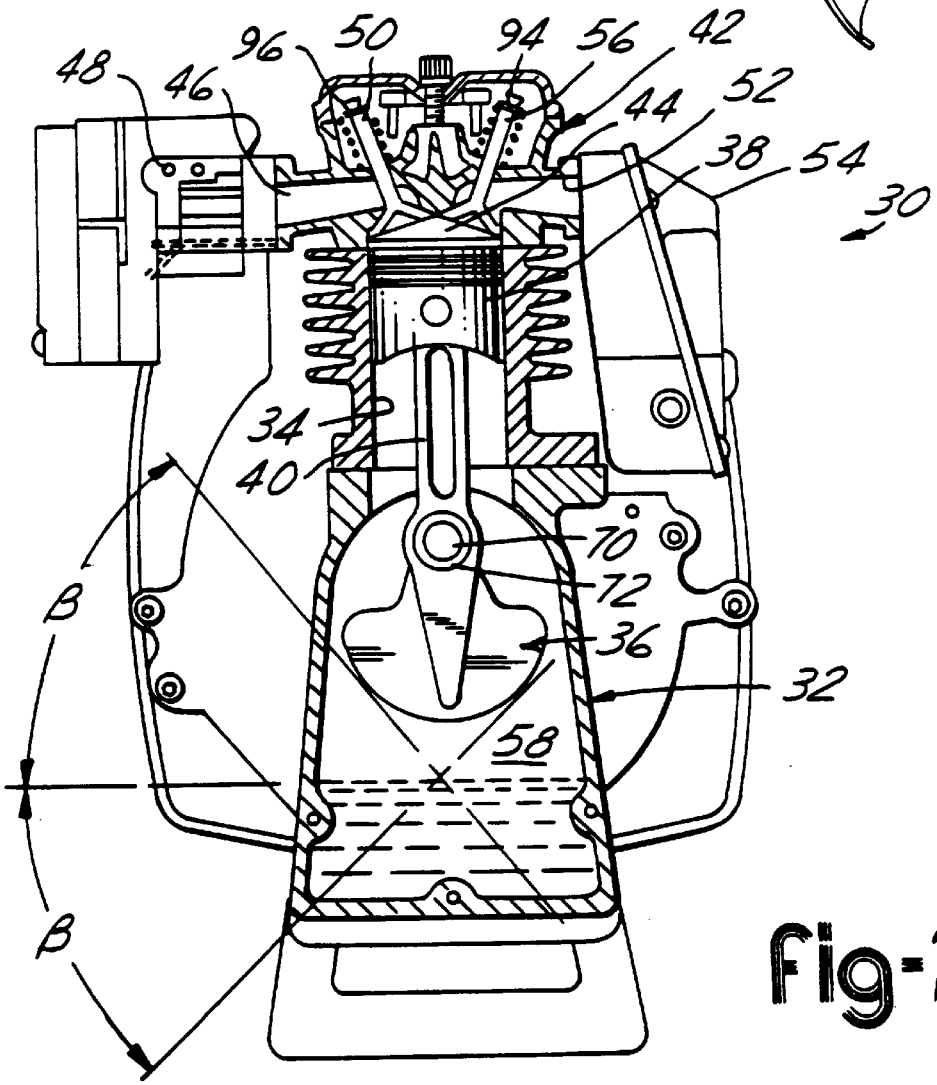
FIG. 2 is a cross-sectional side elevation of the engine taken along line 2.2 of FIG. 1.

FIG. 2 illustrates a cross-sectional end view of a four-cycle engine 30. Four-cycle engine 30 is made up of a lightweight aluminum housing including an engine block 32 having a cylindrical bore 34 formed therein. Crankshaft 36 is pivotably mounted within the engine block in a conventional manner. Piston 38 slides within a cylindrical bore 34 and is connected to the crankshaft by connecting rod 40. A cylinder head 42 is affixed to the engine block to define an enclosed combustion chamber 44. Cylinder head 42 is provided with intake port 46 coupled to a carburetor 48 and selectively connected to the combustion chamber 44 by intake valve 50. Cylinder head 42 is also provided with an exhaust port 52 connected to muffler 54 and selectively connected to combustion chamber 44 by exhaust valve 56.

Figure 3:
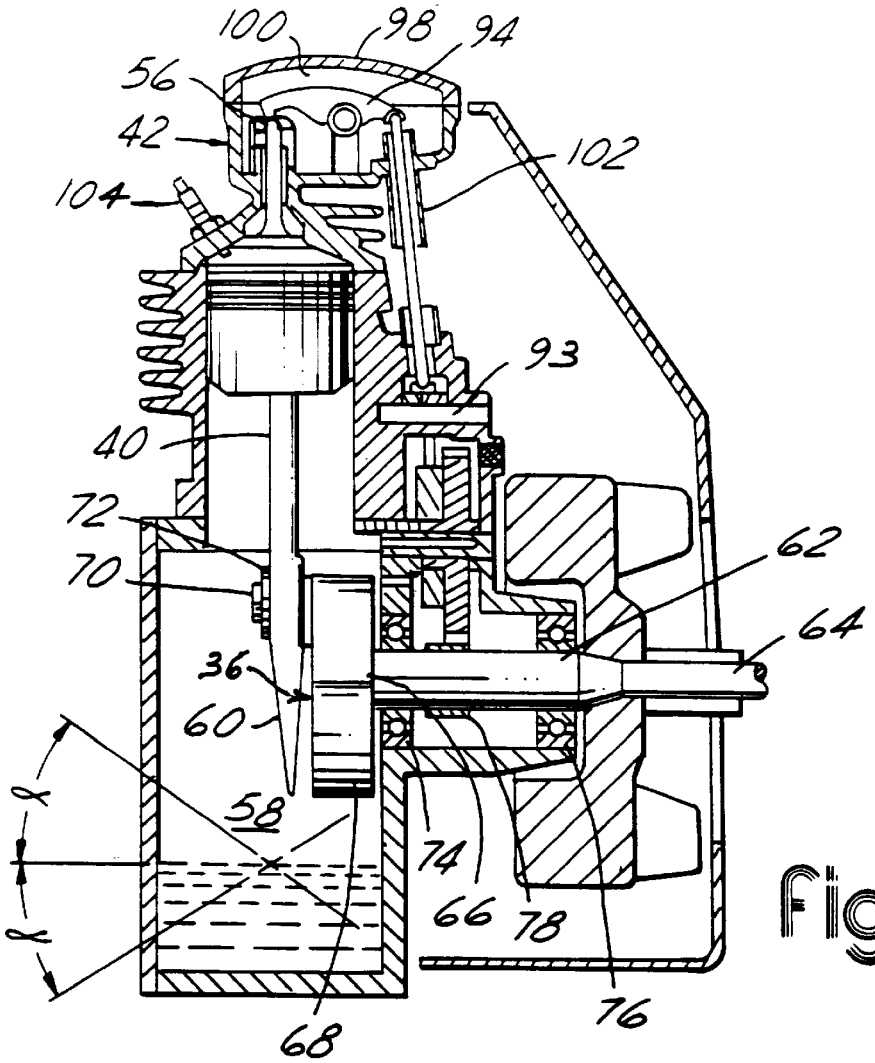
FIG. 3 is a side cross-sectional elevational view of the engine of FIG. 2.

As illustrated in FIGS. 2 and 3, the cylinder axis of four-cycle engine 30 is generally upright when in normal use. Engine block 32 is part of a housing portion that provides an enclosed oil reservoir 58. The reservoir is relatively deep so that there is ample clearance between the crankshaft and the level of the oil during normal use. As illustrated in FIG. 2, the engine may be rotated about the crankshaft axis plus or minus at angle $\beta$ before the oil level would rise sufficiently to contact the crankshaft. Preferably, $\beta$ is at least above 30° and most preferably at least 45° in order to avoid excessive interference between the crankshaft and the oil within the oil reservoir. As illustrated in a cross-sectional side elevation shown in FIG. 3, the engine shown in its vertical orientation would typically be used in a line trimmer canted forward 20° to 30°. As illustrated, the engine can be tipped fore and aft plus or minus an angle $\alpha$ without the oil within the reservoir striking the crankshaft. Again, preferably the angle a is at least above 20° viewing the engine in side view along the transverse axis orthogonal to the axes of the engine crankshaft 36 and the cylinder bore 34.

In order to lubricate the engine, connecting rod 40 is provided with an oil mist generator or splasher portion 60 which dips into and agitates the oil within the reservoir with each crankshaft revolution. The splasher 60 is an oil mist generator that creates, as it is driven by the piston-connecting rod-crankshaft assembly, an oil mist which lubricates the internal moving parts within the engine block.

As illustrated in FIG. 3, the crankshaft 36 is of a cantilever design similar to that commonly used by small two-cycle engines. The crankshaft is provided with an axial shaft member 62 having an output end 64 adapted to be coupled to the implement input member and input end 66 coupled to a counterweight 68. A crankpin 70 is affixed to counterweight 68 and is parallel to and radially offset from the axial shaft 62. Crankpin 70 pivotally cooperates with a series of roller bearings 72 mounted in connecting rod 40. The axial shaft 62 of crankshaft 36 is pivotably attached to the engine block 32 by a pair of conventional bearings 74 and 76. Intermediate bearings 74 and 76 is camshaft drive gear 78.

Figure 4:
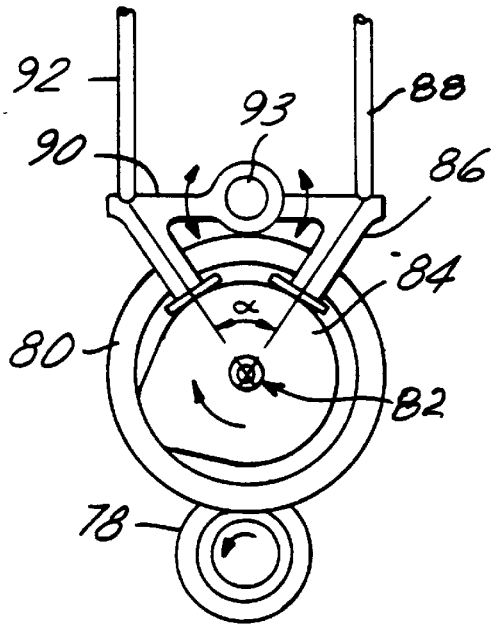
FIG. 4 is an enlarged schematic illustration of the camshaft and the follower mechanism.

The camshaft drive and valve lifter mechanism is best illustrated with reference to FIGS. 3 and 4. Drive gear 78 which is mounted upon the crankshaft drives cam gear 80 which is twice the diameter resulting in the camshaft rotating in one-half engine speed. Cam gear 80 is affixed to the camshaft assembly 82 which is journaled to engine block 32 and includes a rotary cam lobe 84. In the embodiment illustrated, a single cam lobe is utilized for driving both the intake and exhaust valves. However, a conventional dual cam system could be utilized as well. Cam lobe 84, as illustrated in FIG. 4, operates intake valve follower 86 and intake push rod 88 as well as exhaust valve follower 90 and exhaust push rod 92. Followers 86 and 90 are pivotably connected to the engine block by pivot pin 93. Push rods 88 and 92 extend between camshaft followers 86 and 90 and rocker arms 94 and 96 located within the cylinder head 42. The cam push rods and rocker arms are part of a valve train assembly. Affixed to the cylinder head 42 is a valve cover 98 which defines therebetween enclosed valve chamber 100 which defines therebetween enclosed valve chamber 100. A pair of push rod tubes 102 surround the intake and exhaust push rods 88 and 92 in a conventional manner in order to prevent the entry of dirt into the engine. In the embodiment of the invention illustrated, four-cycle engine 30 has a sealed valve chamber 100 which is isolated from the engine block and provided with its own lubricant. Preferably, valve chamber 100 is partially filled with a lightweight moly grease. Conventional valve stem seals, not shown, are provided in order to prevent escape of lubricant.

Engine 30 operates on a conventional four-cycle mode. Spark plug 104 is installed in a spark plug hole formed in the cylinder head so as to project into enclosed combustion chamber 44. The intake charge provided by carburetor 48 will preferably have an air fuel ration which is slightly lean stoichiometric; i.e., having an air fuel ratio expressed in terms of stoichiometric ration which is not less than 1.0. It is important to prevent the engine from being operated rich so as to avoid a formation of excessive amount of hydrocarbon (HC) and carbon monoxide (CO) emissions. Most preferably, the engine will operate during normal load conditions slightly lean of stoichiometric in order to minimize the formation of HC, CO and oxides of nitrogen (NOx). Running slightly lean of stoichiometric air fuel ratio will enable excess oxygen to be present in the exhaust gas thereby fostering post-combustion reduction of hydrocarbons within the muffler and exhaust port.

For use in a line trimmer of the type illustrated in FIG. 1, adequate power output of a small lightweight four-cycle engine is achievable utilizing an engine with a displacement less than 50 cc. Preferably, engines for use in the present invention will have a displacement falling within the range of 20 and 40 cc. Engines of displacement larger than 50 cc will result in excessive weight to be carried by an operator. Engines of smaller displacement will have inadequate power if operated in such a manner to maintain low emission levels.

In order to achieve high power output and relatively low exhaust emissions, four-cycle engine 30 is provided with a very compact combustion chamber 44 having a relatively low surface to volume ration. In order to maximize volumetric efficiency and engine output for relatively small engine displacement, canted valves shown in FIG. 2 are used resulting in what is commonly referred to as a hemispherical-type chamber. Intake and exhaust ports 46 and 52 are oriented in line and opposite one another resulting in a cross flow design capable of achieving very high horsepower relative to engine displacement compared to a typical four-cycle lawn mower engine having a flat head and a valve-in-block design.

Figure 5:
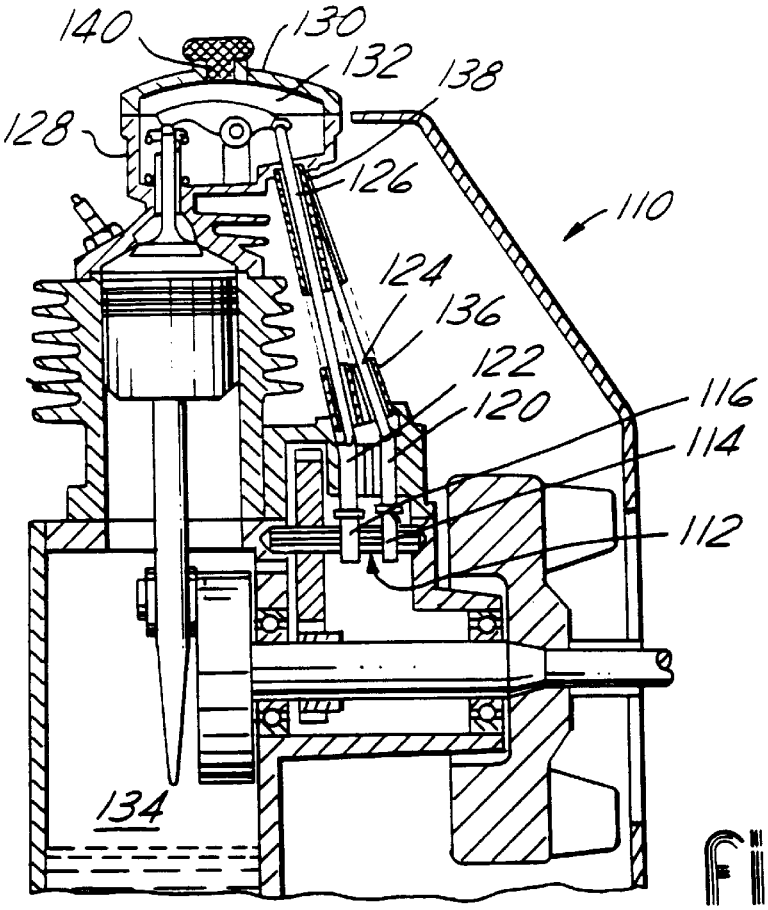
FIG. 5 is a cross-sectional side elevational view of a second engine embodiment.
Figure 6:
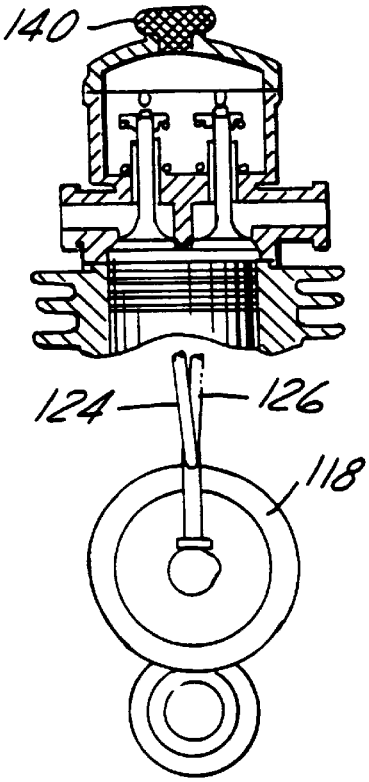
FIG. 6 is a cross-sectional end view illustrating the valve train of the second engine embodiment of FIG. 5.

A second engine embodiment 110 is illustrated in FIGS. 5 and 6. Engine 110 is very similar to engine 30 described with reference to FIGS. 2–4 except for the valve train and lubrication system design. Engine 110 is provided with a camshaft 112 having a pair of cam lobes, intake cam lobes 114 and exhaust cam lobes 116 affixed to the camshaft and at axially spaced apart orientation. Camshaft 112 is further provided with a cam gear 118 cooperating with a drive gear affixed to the crankshaft as previously described with reference to the first engine embodiment 30. Intake and exhaust followers 120 and 122 are slidably connected to the engine block and are perpendicular to the axis of the camshaft in a conventional manner. Intake and exhaust followers 120 and 122 reciprocally drive intake and exhaust push rods 124 and 126.

Engine 110 also differs from engine 30 previously described in the area of cylinder head lubrication. Cylinder head 128 and valve cover 130 define therebetween an enclosed valve chamber 132. Valve chamber 132 is coupled to oil reservoir 134 by intake and exhaust push rod guide tubes 136 and 138. Valve cover 130 is further provided with a porous breather 140 formed of a sponge-like or sintered metal material. As the piston reciprocates within the bore, the pressure within the oil reservoir will fluctuate. When the pressure increases, mist-laden air will be forced through the valve guide tubes into the valve chamber 132. When the piston rises, the pressure within the oil reservoir 134 will drop below atmospheric pressure causing air to be drawn into the engine breather 140. The circulation of mist-laden air between the engine oil reservoir and the valve chamber will supply lubrication to the valves and rocker arms. By forming the breather of a porous material, the escape of oil and the entry of foreign debris will be substantially prohibited.

FIGS. 7–10 illustrate a third engine embodiment 150 having yet a third system for lubricating overhead valves. Engine 150 has an engine block with a single cam and dual follower design generally similar to that of FIGS. 2 and 3 described previously. Cylinder head 152 is provided with a valve cover 154 to define enclosed valve chamber 156 therebetween. Valve chamber 156 is coupled to oil reservoir 158 within the engine block. In order to include the mist-laden air within the oil reservoir 158 to circulate through valve chamber 156, flow control means is provided for alternatively selectively coupling the valve chamber to the oil reservoir via one of a pair of independent fluid passageways.

As illustrated in FIGS. 8 and 9, intake push rod tube 160 provides a first passageway connecting the oil reservoir to the valve chamber, while exhaust push rod tube 162 provides a second independent passageway connecting the valve chamber 156 to the oil reservoir 158. As illustrated in FIG. 8, port B connects push rode tube 162 to the cylindrical bore 166. Port B intersects the cylindrical bore at a location which is swept by the skirt of piston 168 so that the port is alternatively opened and closed in response to piston movement. Camshaft 170 is pivotally mounted on a hollow tubular shaft 172. Camshaft 170 and support shaft 172 are each provided with a pair of ports A which are selectively coupled and uncoupled once every engine revolution, i.e., twice every camshaft revolution. When the ports are aligned, the oil reservoir is fluidly coupled to the valve chamber via the intake push rod tube 162. When the ports are misaligned, the flow path is blocked.

Figure 10:
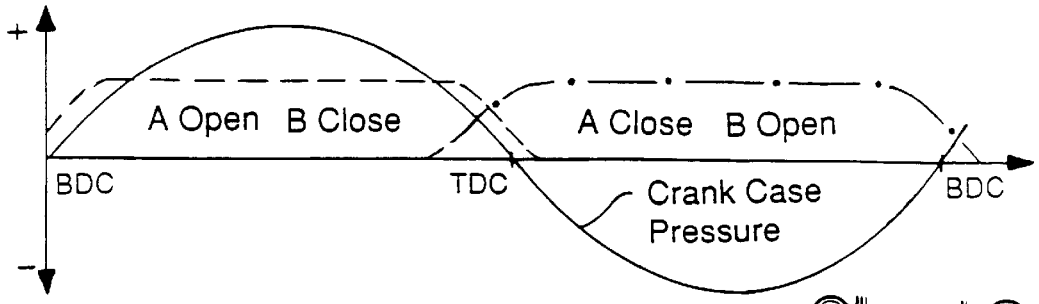
FIG. 10 is a timing diagonal of the lubrication system of the third engine embodiment.

FIG. 10 schematically illustrates the open and close relationship of the A and B ports relative to crankcase pressure. When the piston is down and the crankcase is pressurized, the A port is open allowing mist-laden air to flow through the passageway within camshaft support shaft 172 through the intake push rod tube 160 and into the valve chamber 156. When the piston rises, the crankcase pressure drops below atmospheric pressure. When the piston is raised, the A port is closed and the B port is opened enabling the pressurized air from valve chamber 156 to return to oil reservoir 158.

Of course, other means for inducing the circulation of mist-laden air from the oil reservoir to the valve chamber can be used to obtain the same function, such as check valves or alternative mechanically operated valve designs. Having a loop type flow path as opposed to a single bi-directional flow path, as in the case of the second engine embodiment 110, more dependable supply of oil can be delivered to the valve chamber.

Figure 11:
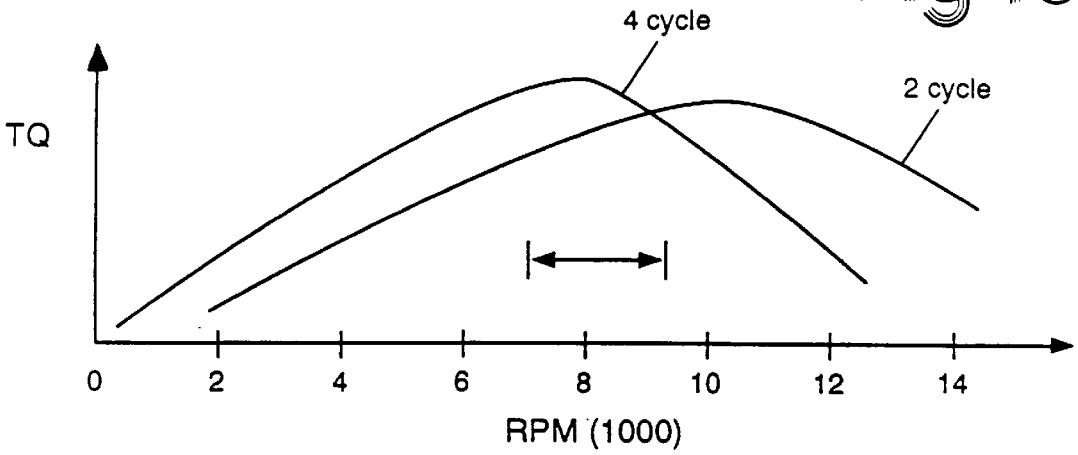
FIG. 11 is a torque versus RPM curve.

It is believed that small lightweight four-cycle engines made in accordance with the present invention will be particularly suited to use with rotary line trimmers, as illustrated in FIG. 1. Rotary line trimmers are typically directly driven. It is therefore desirable to have an engine with a torque peak in the 7000 to 9000 RPM range which is the range in which common line trimmers most efficiently cut. As illustrated in FIG. 11, a small four-cycle engine of the present invention can be easily tuned to have a torque peak corresponding to the optimum cutting speed of a line trimmer head. This enables smaller horsepower engine to be utilized to achieve the same cutting performance as compared to a higher horse power two-cycle engine which is direct drive operated. Of course, a two-cycle engine speed can be matched to the optimum performance speed of the cutting head by using a gear reduction. However, this unnecessarily adds cost, weight and complexity to a line trimmer.

Figure 12:
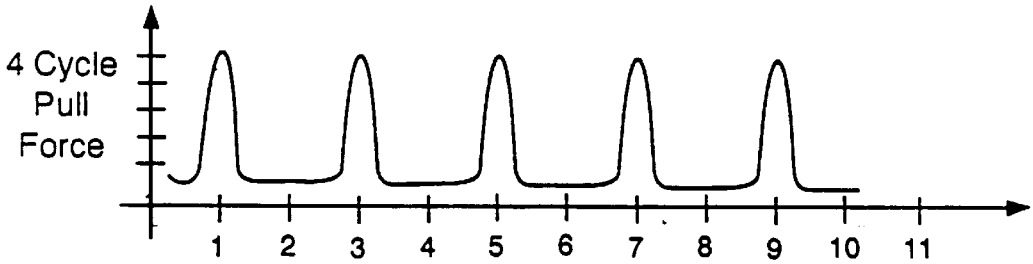
FIG. 12 and FIG. 13 contrast the pull force of a four and a twocycle engine.
Figure 13:
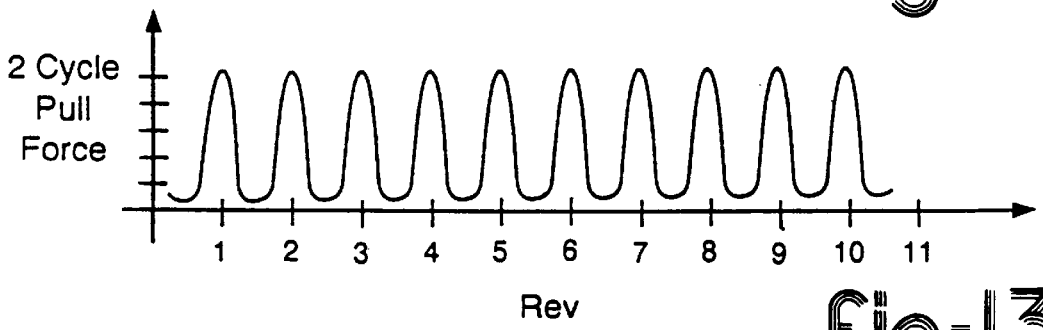

Another advantage to the four-cycle engine for use in a line trimmer is illustrated with reference to FIGS. 12 and 13. FIG. 12 plots the starter rope pull force versus engine revolutions. The force pulses occur every other revolution due to the four-cycle nature of the engine. A two-cycle engine as illustrated in FIG. 13 has force pulses every revolution. It is therefore much easier to pull start a four-cycle engine to reach a specific starting RPM since approximately half of the work needs to be expended by the operator. Since every other revolution of a four-cycle engine constitutes a pumping loop where there is relatively little cylinder pressure, the operator pulling starter rope handle 174 (shown in FIG. 1) is able to increase engine angular velocity during the pumping revolution so that proper starting speed and sufficient engine momentum can be more easily achieved. The pull starter mechanism utilized with the four-cycle engine is of a conventional design. Preferably, the pull starter will be located on the side of the engine closest to the handle in order to reduce the axial spacing between trimmer handle 24 and the starter rope handle 174, thereby minimizing the momentum exerted on the line trimmer during startup. A four-cycle engine is particularly advantageous in line trimmers where in the event the engine were to be shut off when the operator is carrying the trimmer, the operator can simply restart the engine by pulling the rope handle 174 with one hand and holding the trimmer handle 24 with the other. The reduced pull force makes it relatively easy to restart the engine without placing the trimmer on the ground or restraining the cutting head, as is frequently done with two-cycle line trimmers.

It should be understood, of course, that while preferred embodiments of the invention have been shown and described herein, it is not intended to illustrate all possible variations thereof. Alternative structures may be created by one of ordinary skill in the art without departing from the spirit and scope of the invention as set forth in the following claims.

We claim:

1. A single-cylinder, four-stroke cycle, spark ignition internal combustion engine for mounting on a hand-held power tool comprising:

a cylinder block having a power cylinder, a cylinder head and a cam housing, a power piston mounted for reciprocation in said power cylinder to define a displacement of 50 cc or less, said cylinder head defining an air-fuel combustion chamber;

an air-fuel mixture intake port and an exhaust gas port in said cylinder head;

a valve cover on said cylinder head defining a valve chamber;

intake and exhaust valves mounted in said intake and exhaust ports, respectively, for reciprocation between port-open and port-closed positions;

a valve-actuating valve train, said valve train including at least one rocker arm and at least one valve train push rod assembly extending at one end thereof within said valve chamber and engaging said rocker arm;

a crankshaft rotatably mounted in said cylinder block including a crank portion and a counterweight;

a connecting rod having articulated connections at one end thereof to said piston and at the opposite end thereof to said crank portion thereby forming a piston-connecting rod crankshaft assembly;

a cam rotatably mounted in said cam housing, said cam being drivably connected to said crankshaft and driven at one-half crankshaft speed, the opposite end of said push rod assembly being drivably connected to said cam whereby said push rod assembly is actuated with a reciprocating motion upon rotation of said cam;

said power cylinder, said crankshaft and said cam being located in a common plane;

a lubrication oil reservoir, an oil mist generator element connected drivably to said piston-connecting rod-crankshaft assembly, said element agitating lubrication oil into a mist in said reservoir, said reservoir being in fluid communication with said power cylinder whereby pressure pulses are created in said mist upon reciprocating movement of said piston;

oil mist passages extending between said reservoir and said valve chamber, said pressure pulses establishing flow of said mist through said passages; and a valve mechanism controlling the flow of said mist through said passages to and from said valve chamber whereby a continuous flow of lubricating oil is circulated through said engine.

2. The engine set forth in claim 1 wherein said valve mechanism includes an oil mist flow control valve structure establishing a lubrication oil mist flow circuit from said reservoir to said valve chamber through said cylinder block and from said valve chamber to said reservoir.

3. The engine set forth in claim 1 wherein said driving connection between said cam and said crankshaft comprises a cam gear driven by said crankshaft, said valve mechanism including said cam gear, a valve port in said cam gear registering with said one passage whereby said one passage is alternately opened and closed during revolution of said cam.

4. The engine set forth in claim 1 including at least one push rod guide tube extending from said cylinder block to said cylinder head, said guide tube having ends extending within said cylinder block and said cylinder head;

said guide tube ends being sealed within said cylinder block and said head to form a closed oil mist passage, said push rod extending through said push rod tube.

5. The engine set forth in claim 1 wherein said oil mist generator element is integrally attached with said opposite end of said connecting rod.

6. A hand-held, portable power tool to be carried by an operator in use, comprising:

a frame, including a handle positioned on said power tool permitting it to be carried by an operator;

an implement; cooperating with said frame and having a rotary-driven input member;

a four-stroke cycle, internal combustion, spark-ignition engine attached to said frame, said engine having;

a lightweight aluminum engine block having a cylinder bore and an oil reservoir;

a rotary crankshaft in the engine block having an output end attached to said implement input member, said crankshaft having a radially offset crankpin and a counterweight;

a piston mounted within said bore for reciprocation and providing an engine displacement of 50 cc or less;

a connecting rod assembly including a first end having a bearing providing a pivotal connection with said piston, a second end of said connecting rod assembly having a bearing providing a pivotal connection with said crankpin;

a splasher connected drivably to said crankshaft for engaging oil in said reservoir to generate an oil mist in said reservoir to lubricate the engine;

a cam rotatably mounted in said engine block and connected drivably to said crankshaft whereby it is driven at one-half engine speed;

a cylinder head assembly on said block defining a combustion chamber, said cylinder head assembly having overhead intake and exhaust ports, and a spark plug hole extending into the combustion chamber with an intake valve, an exhaust valve and a spark plug respectively cooperating therewith, said intake and exhaust valves and ports being disposed at substantially diametrically opposed, off-center locations in said combustion chamber thereby creating cross flow of combustion chamber gases, a valve train drivably connecting said cam to said intake and exhaust valves;

a valve cover attached to said cylinder head assembly and defining a valve chamber at least partially enclosing the valve train;

a head lubrication system including a passageway connecting said oil reservoir to said valve chamber to provide oil mist flow to said valve chamber to lubricate said valve train, said valves, said crankshaft and said cam; and a second passageway connecting said oil reservoir to the valve chamber and a valve mechanism for selectively opening and closing said passageways to induce circulation of oil-ladened mist between said oil reservoir and said valve chamber.

7. A single-cylinder, four-stroke cycle, spark-ignition, internal combustion engine for mounting on a hand-held power tool comprising:

a cylinder block having a power cylinder, a cylinder head and a cam housing, a power piston mounted for reciprocation in said power cylinder, said cylinder head defining an air-fuel combustion chamber;

a throttle-controlled, air-fuel induction system including an air-fuel mixture intake port and an exhaust gas port in said cylinder head for regulating air and fuel flow to said intake valve;

a valve train housing, intake and exhaust valves mounted in said intake and exhaust ports, respectively, for reciprocation between port-open and port-closed positions;

a valve-actuating train including a pair of rocker arms and a pair of push rod assemblies extending at one end thereof within said valve train housing and engaging said rocker arms for transferring motion to said pair of rocker arms;

a crankshaft rotatably mounted in said cylinder block including a crank portion and a counterweight;

a connecting rod assembly having articulated connections at one end thereof to said piston and at the opposite end thereof to said crank portion;

a cam mounted for rotation in said cam housing, said cam being drivably connected to said crankshaft, the opposite ends of said push rod assembly engaging said cam whereby said push rod assembly is actuated with a reciprocating motion upon rotation of said cam;

said power cylinder, said crankshaft and said cam having axes located in a common plane;

a lubrication oil reservoir, an oil mist generator element connected drivably to said crankshaft, said generator element agitating lubrication oil in said reservoir into a mist, said reservoir being in fluid communication with said power cylinder whereby pressure pulses are created in said mist upon reciprocating movement of said piston;

oil mist passages extending between said reservoir and said valve train housing, said pressure pulses establishing flow of said mist through said passages; and an oil mist valve for controlling flow of said mist through said passages to and from said valve train housing whereby a continuous flow of lubricating oil is circulated through said engine.

8. The engine set forth in claim 7 wherein said oil mist flow control valve establishes a lubrication oil mist flow path from said reservoir to said valve train housing and from said valve train housing to said reservoir, said oil mist flow path extending through said cam housing in order to lubricate said intake and exhaust valves, said valve-actuating train, said crankshaft, said piston, and said cam.

9. The engine set forth in claim 7 wherein said intake and exhaust ports are disposed in said cylinder head at spaced locations in said combustion chamber and a spark plug opening disposed generally intermediate said intake and exhaust ports whereby said air-fuel mixture is induced into said combustion chamber in a cross flow fashion, and near stoichiometric combustion may be maintained at standard operating conditions throughout a wide range of throttle settings.

10. The engine set forth in claim 7 including a pair of push rod guide tubes extending from said cylinder block to said cylinder head, said guide tubes having ends extending within said cylinder block and said cylinder head;

said guide tube ends being sealed within said cylinder block and said head to form a closed oil mist passage, said push rod extending through said push rod tubes.

11. The engine set forth in claim 7 wherein said driving connection between said cam and said crankshaft comprises a cam gear driven by said crankshaft, said oil mist valve including said cam gear, one of said passages extending to said cam gear, a valve port in said cam gear registering with said one passage whereby said one passage is alternately opened and closed during revolution of said cam.

12. A lubrication method for lubricating a lightweight, four-stroke cycle, throttle-controlled, internal combustion engine used with a power tool to be carried by an operator when in use, the engine having an engine block, a reciprocating piston in a cylinder in the engine block, a crankshaft, at least one bearing supporting said crankshaft, a cam, a cam gear, a valve train, a pair of rocker arms, an oil reservoir and a cylinder head defining an intake and exhaust valve chamber and overhead intake and exhaust valves, the method comprising the steps of:

creating within said oil reservoir a lubrication oil mist;

providing said oil mist to said piston, said crankshaft, said bearing, said cam, said cam gear, said valve train, said pair of rocker arms, and said overhead intake and exhaust valves by conducting the oil mist through a passage from said reservoir to the valve chamber;

conducting the oil mist in a return flow passage through said engine block from said valve chamber to said reservoir; and controlling the flow of oil mist from said reservoir to said valve chamber in synchronism with increases and decreases in gas pressure in said engine block below said piston as said piston reciprocates in said cylinder whereby oil mist is distributed to said valve chamber during normal maneuvers of said power tool by the operator throughout a range of angular orientations relative to vertical disposition of said cylinder.

* * * * *

UNITED STATES PATENT AND TRADEMARK OFFICE

CERTIFICATE OF CORRECTION

PATENT NO. : 5,950,590

DATED : September 14, 1999

INVENTOR(S) : Robert G. Everts et al.

It is certified that error appears in the above-identified patent and that said Letters Patent is hereby corrected as shown below:

On the Title Page

In column 2, line 11, delete "Holer" and substitute --Hofer-- in its place.

In the Claims

In claim 6, line 37, delete "," (comma) and substitute --;-- (semicolon) in its place.

Signed and Sealed this

Twenty-ninth Day of May, 2001

*Attest:*

Nicholas P. Godici

NICHOLAS P. GODICI

*Attesting Officer*

*Acting Director of the United States Patent and Trademark Office*